US008631755B2

(12) United States Patent
Klein et al.

(10) Patent No.: US 8,631,755 B2
(45) Date of Patent: Jan. 21, 2014

(54) TRAFFIC CONE INSERT THAT SUPPORTS CAUTION TAPE

(76) Inventors: Erik D. Klein, Uniontown, OH (US); John Henry Layman, Dearborn, MI (US)

( * ) Notice: Subject to any disclaimer, the term of this patent is extended or adjusted under 35 U.S.C. 154(b) by 376 days.

(21) Appl. No.: 13/046,442

(22) Filed: Mar. 11, 2011

(65) Prior Publication Data

US 2011/0220010 A1 Sep. 15, 2011

Related U.S. Application Data

(60) Provisional application No. 61/313,180, filed on Mar. 12, 2010.

(51) Int. Cl.
*E01F 9/012* (2006.01)

(52) U.S. Cl.
USPC ..... 116/63 C; 116/63 P; 40/607.1; 40/612

(58) Field of Classification Search
USPC ..... 116/63 C, 63 P, 63 R; 40/604, 605, 606.1, 40/606.14, 607.01, 607.04, 607.1, 610, 40/611.05, 612; 248/224.7, 231.9, 346.03, 248/346.04, 346.5, 412, 511, 518, 519, 523, 248/539, 558, 686; 404/9, 10
See application file for complete search history.

(56) References Cited

U.S. PATENT DOCUMENTS

| | | | | |
|---|---|---|---|---|
| 2,762,328 | A | | 9/1956 | Weig |
| 2,949,531 | A | | 8/1960 | Lemelson |
| 3,380,428 | A | | 4/1968 | Abrams |
| 3,386,409 | A | | 6/1968 | Dawson |
| 3,732,842 | A | | 5/1973 | Vara |
| 4,197,808 | A | | 4/1980 | Kinninger |
| 5,036,791 | A | | 8/1991 | Thurston |
| 5,195,453 | A | | 3/1993 | McGibbon |
| 5,269,251 | A | * | 12/1993 | Freeman ..... 116/63 C |
| 5,375,553 | A | | 12/1994 | Chen |
| 5,467,548 | A | | 11/1995 | Ross |
| 5,749,673 | A | | 5/1998 | Kulp |
| 5,755,174 | A | * | 5/1998 | Freeman ..... 116/63 C |
| 5,888,016 | A | * | 3/1999 | Ahn ..... 404/10 |
| 6,095,716 | A | | 8/2000 | Kulp |
| 6,119,621 | A | * | 9/2000 | Johnson ..... 116/63 C |
| 6,142,701 | A | * | 11/2000 | Falcon ..... 404/6 |
| 6,186,699 | B1 | | 2/2001 | Kulp |
| 6,305,312 | B1 | | 10/2001 | Bent |
| D462,286 | S | | 9/2002 | Perelli |
| 6,448,902 | B1 | | 9/2002 | Tung |
| 6,520,712 | B2 | | 2/2003 | Kulp |

(Continued)

FOREIGN PATENT DOCUMENTS

| | | |
|---|---|---|
| GB | 665785 | 1/1952 |
| GB | 2039354 | 8/1980 |

(Continued)

*Primary Examiner* — R. A. Smith
(74) *Attorney, Agent, or Firm* — Zollinger & Burleson Ltd.

(57) ABSTRACT

A device used with a traffic cone to support caution tape includes at least one head extending from a body. The head is received in the opening defined at the top of a typical traffic cone to support the device in an upright position with respect to the cone. The body of the device is adapted to support a section of caution tape. The body may define a slot that allows the tape to be supported in an unfolded condition.

20 Claims, 13 Drawing Sheets

(56) References Cited

U.S. PATENT DOCUMENTS

| | | | | |
|---|---|---|---|---|
| 6,536,369 | B1 | 3/2003 | Bent | |
| D472,490 | S | 4/2003 | Perelli | |
| 6,769,380 | B1 * | 8/2004 | Carvajalino et al. | 116/63 P |
| 7,306,398 | B2 | 12/2007 | Doran | |
| D621,289 | S | 8/2010 | Cortez et al. | |
| 8,177,185 | B2 * | 5/2012 | Priegel | 248/539 |
| 2010/0031546 | A1 * | 2/2010 | Nwatu | 40/607.1 |
| 2013/0192149 | A1 * | 1/2013 | Roach | 52/165 |

FOREIGN PATENT DOCUMENTS

| | | | | | |
|---|---|---|---|---|---|
| GB | 2199400 | A | * | 7/1988 | F21Q 3/00 |
| GB | 2214209 | A | * | 8/1989 | E01F 9/00 |
| JP | 2001248119 | A | * | 9/2001 | E01F 13/00 |
| JP | 2002038434 | A | * | 2/2002 | E01F 13/00 |
| JP | 2011089309 | A | * | 5/2011 | E01F 9/012 |
| WO | WO 0075432 | A1 | * | 12/2000 | E01F 9/02 |
| WO | WO 2004016955 | A1 | * | 2/2004 | F16B 9/02 |

* cited by examiner

TRAFFIC CONE INSERT THAT SUPPORTS CAUTION TAPE

CROSS REFERENCE TO RELATED APPLICATIONS

This application claims the benefit of U.S. Provisional Patent Application Ser. No. 61/313,180 filed Mar. 12, 2010; the disclosures of which are incorporated herein by reference.

BACKGROUND OF THE INVENTION

1. Technical Field

The invention relates to traffic safety cones and, more particularly, to an insert that fits into the top of the traffic safety cone to allow the cone to be used with safety tape and signs. Specifically, the invention relates to the structure of an insert that is used with a traffic cone to support caution tape, signs, and to function as a handle for the cone.

2. Background Information

People often string brightly-colored caution tape around construction projects, machinery, open electrical units, changed site conditions, and temporary obstructions to limit access to the site and to provide notice that conditions are more dangerous inside the perimeter of the caution tape. Caution tape is often strung between fixed items disposed around the site. When such fixed items are not available in a desired location, the person stringing the caution tape adds a temporary fixture to support the caution tape. When the fixture is located in soft ground, common temporary fixtures include wooden stakes and pieces of spare rebar that may be pounded into the ground. When the fixture is located on hard ground, cement, or asphalt, a weighted bucket or barrel may be used to directly support the caution tape or to support an upwardly extending temporary fixture to support the caution tape. The hassle of providing temporary fixtures for supporting caution tape can lead to people not stringing the tape or taking shortcuts with the location of the tape.

Traffic safety cones are widely available and are a commonly-recognized indicator of a dangerous or uncommon condition. Traffic cones typically stack such that they are easy to store and transport large quantities of the cones. A drawback with barricading a site with traffic cones is that one can readily pass between the cones. Someone who is not paying attention to his direction may thus pass unaware between cones and encounter the uncommon site condition inside the cones. Those facing these barricading problems thus desire a device that may be used with a traffic cone to support caution tape. These people also may wish to use multiple rows of spaced caution tape or to lift a single strip of caution tape above the top of a traffic cone.

Another problem encountered when people string caution tape on temporary fixtures is that the tape is often tied to the fixture or twisted around the fixture. When tied or twisted, the tape is pinched or bunched thus reducing the visible surface of the tape. Such pinching and bunching thus reduces the effectiveness of the caution tape.

SUMMARY OF THE INVENTION

The invention provides a device that may be used with a traffic cone to support caution tape. The device includes at least one head extending from a body. The head is adapted to be received in the opening defined at the top of a typical traffic cone to support the device in an upright position with respect to the cone. The body of the device is adapted to support a section of caution tape.

A different configuration of the invention provides a lift tube that is used to raise the height of the caution tape holding device to a level well above the upper surface of a traffic cone. The lift tube may have a fixed length or may be extendible to provide for an adjustable length.

Another configuration of the invention provides an opening in the head of the device for receiving a mount or signpost that supports a sign.

Another configuration of the invention provides a device that can be mounted to a traffic cone and includes a magnetic mount for other mounting locations.

Another configuration of the invention provides a pair of heads disposed on opposite ends of the body with the heads being configured to be received by different-sized traffic cones.

In one configuration, the invention provides a device that supports caution tape in an un-pinched configuration. In this configuration, the device defines a tape slot that has a height that is taller than or the same as the width of the tape that is to be used with the device. The slot allows the caution tape to pass through the device in a flat or nearly-flat configuration to prevent or limit pinching of the tape.

This invention allows traffic cones to be used to support caution tape and a, in some configurations, with a message board to provide a safety device capable of being readily installed in a variety of locations. Prior solutions include barrels and other types of barricades. Such barrels and other devices require a lot of storage, equipment cost (rental or purchase), manpower for placement. The invention may be used with existing cones so that one can direct traffic and restrict traffic out of areas keeping the project safer for everyone.

BRIEF DESCRIPTION OF THE DRAWINGS

The drawings are not to scale. Similar numbers refer to similar parts throughout the application.

DETAILED DESCRIPTION OF THE INVENTION

Figure 1:
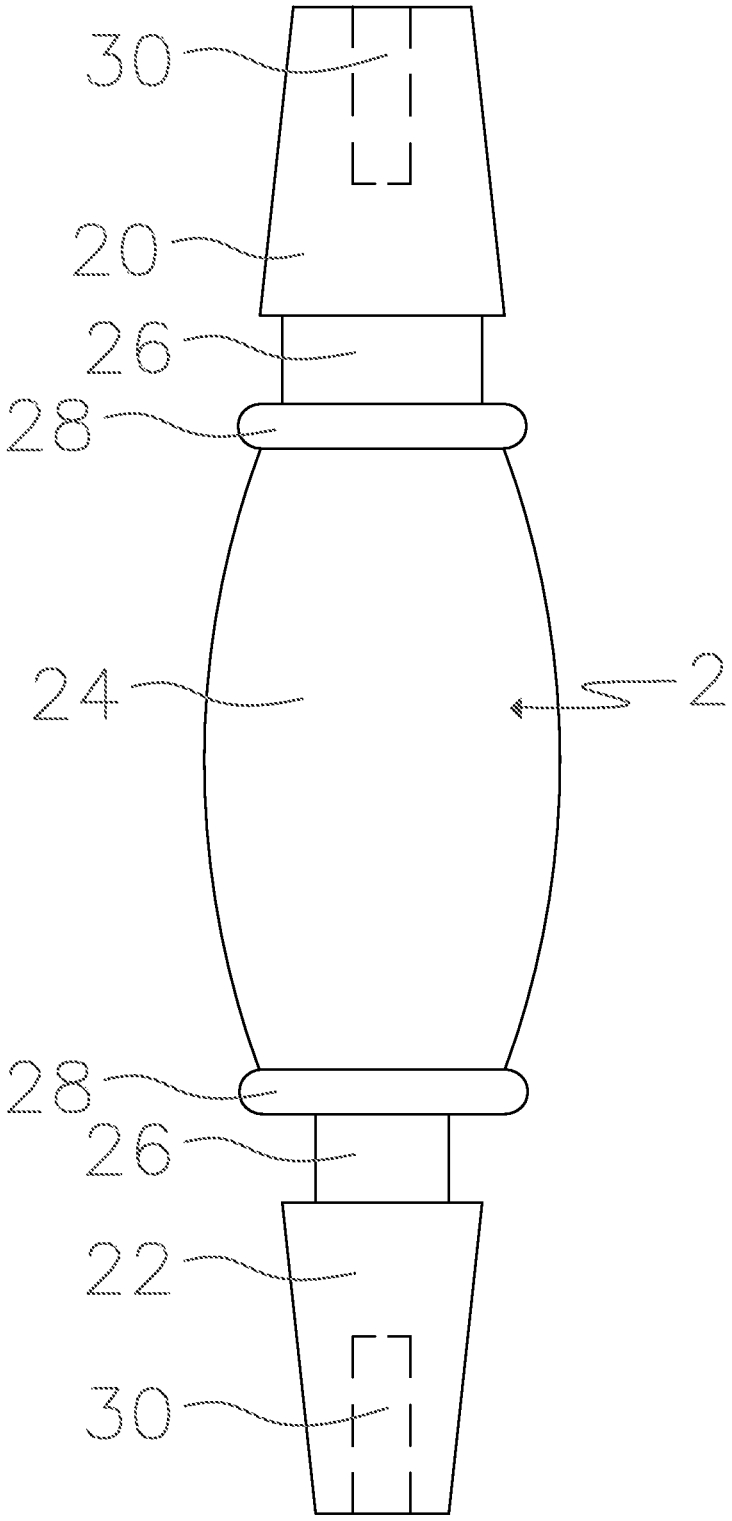
FIG. 1 is a side view of a first configuration of the insert.
Figure 2A:
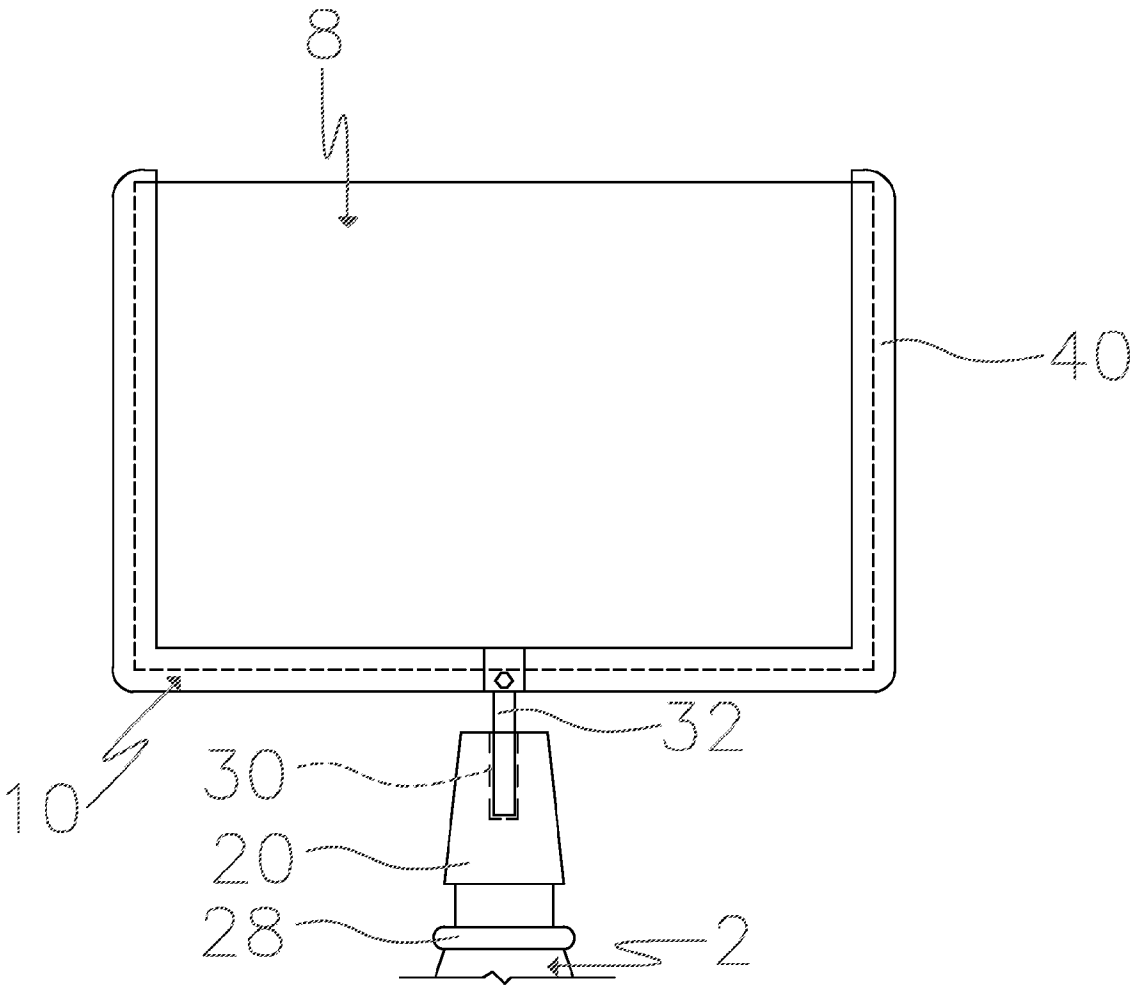
FIG. 2A is a front view of an exemplary sign holder used with the first configuration of the insert.
Figure 2C:
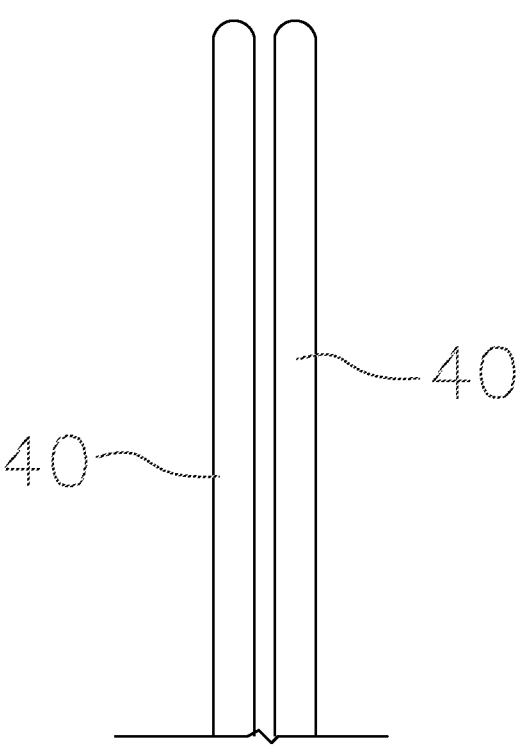
FIG. 2C is a side view of the cradle of the sign mount.
Figure 2B:
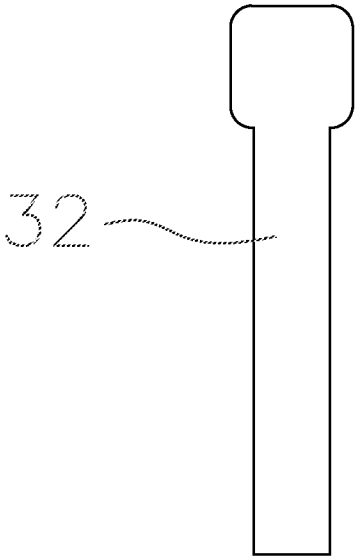
FIG. 2B is a front view of the mount for the sign holder.
Figure 3:
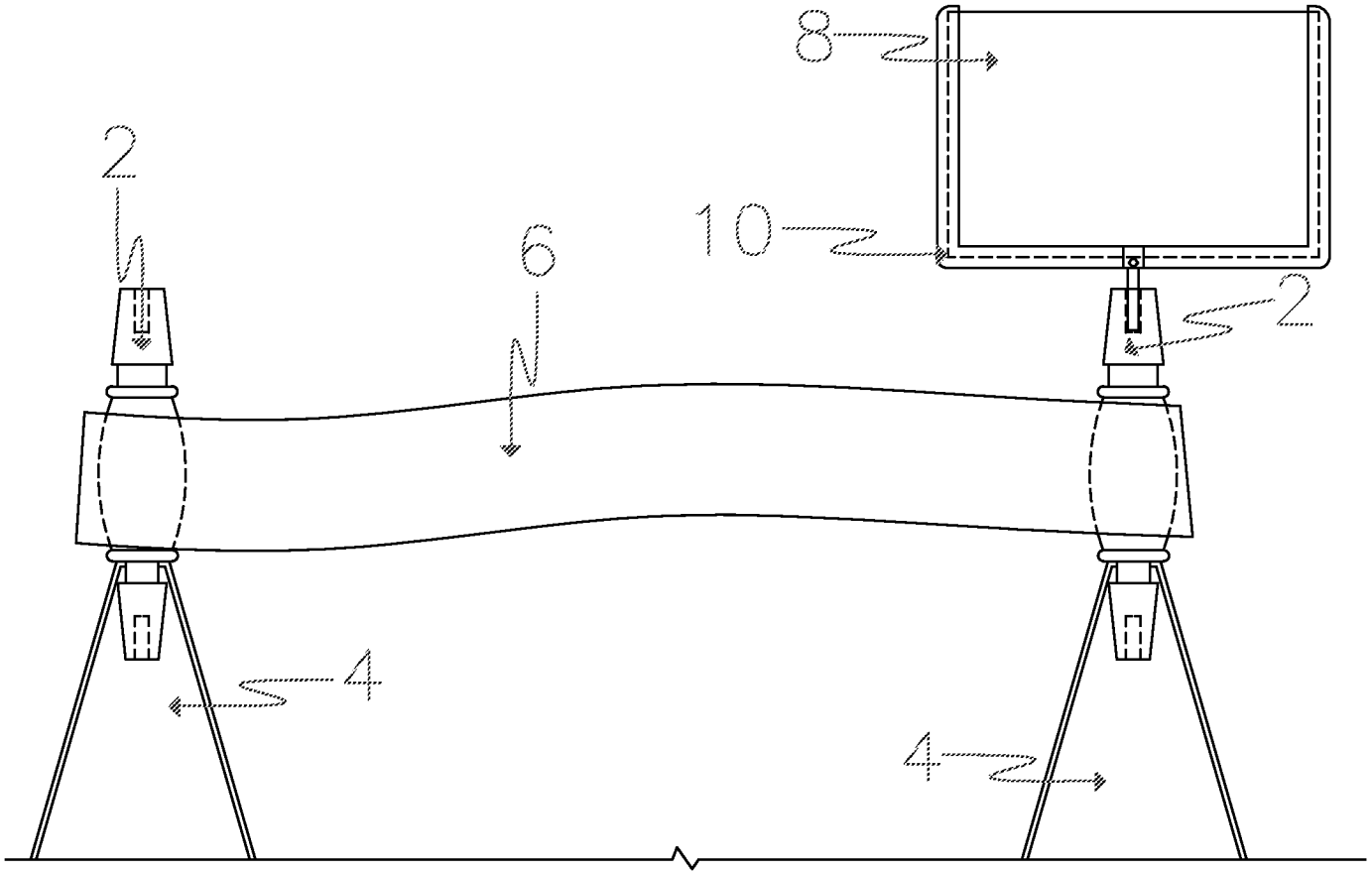
FIG. 3 depicts a pair of inserts used with a pair of traffic cones to support caution tape.
Figure 4:
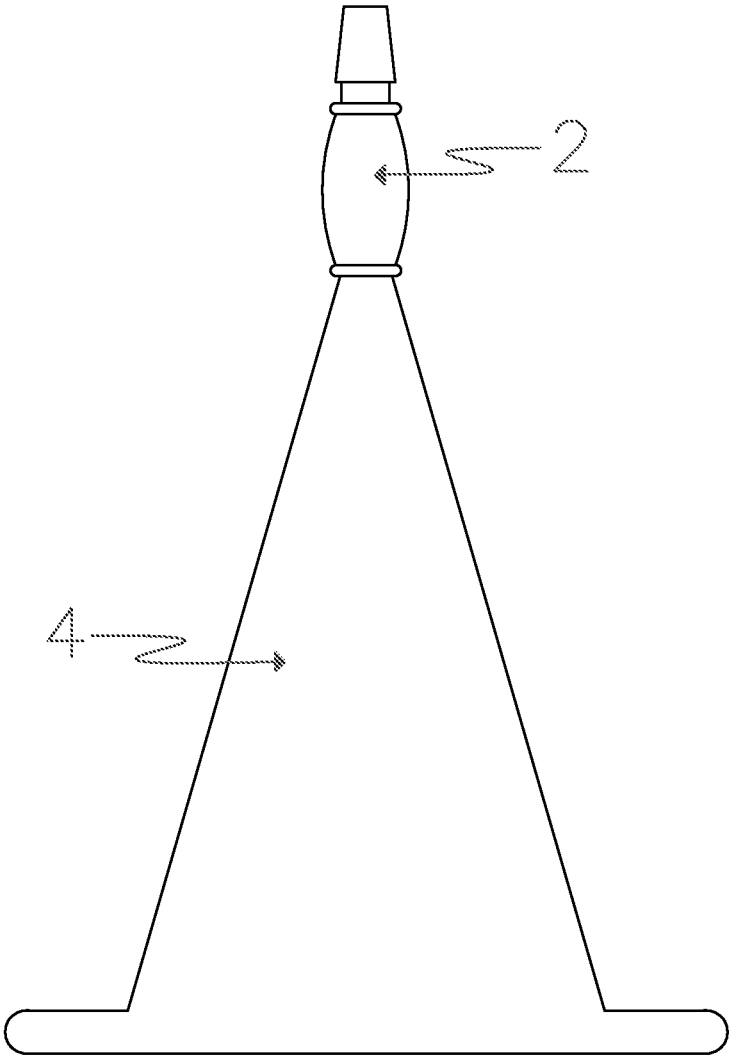
FIG. 4 is a front view of the inset disposed in the top of a traffic cone.
Figure 5:
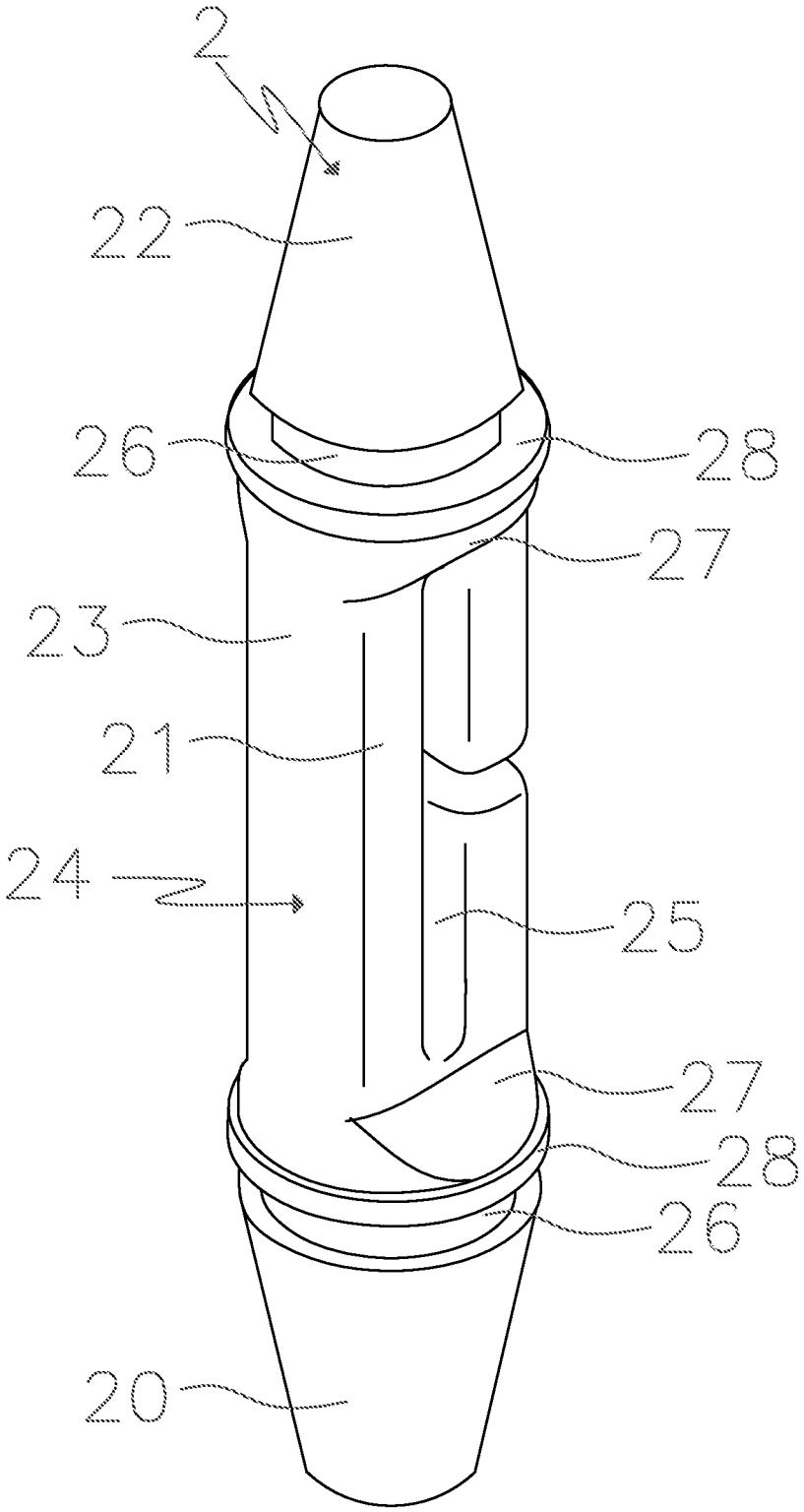
FIG. 5 is a perspective view of a second configuration for the insert.
Figure 6:
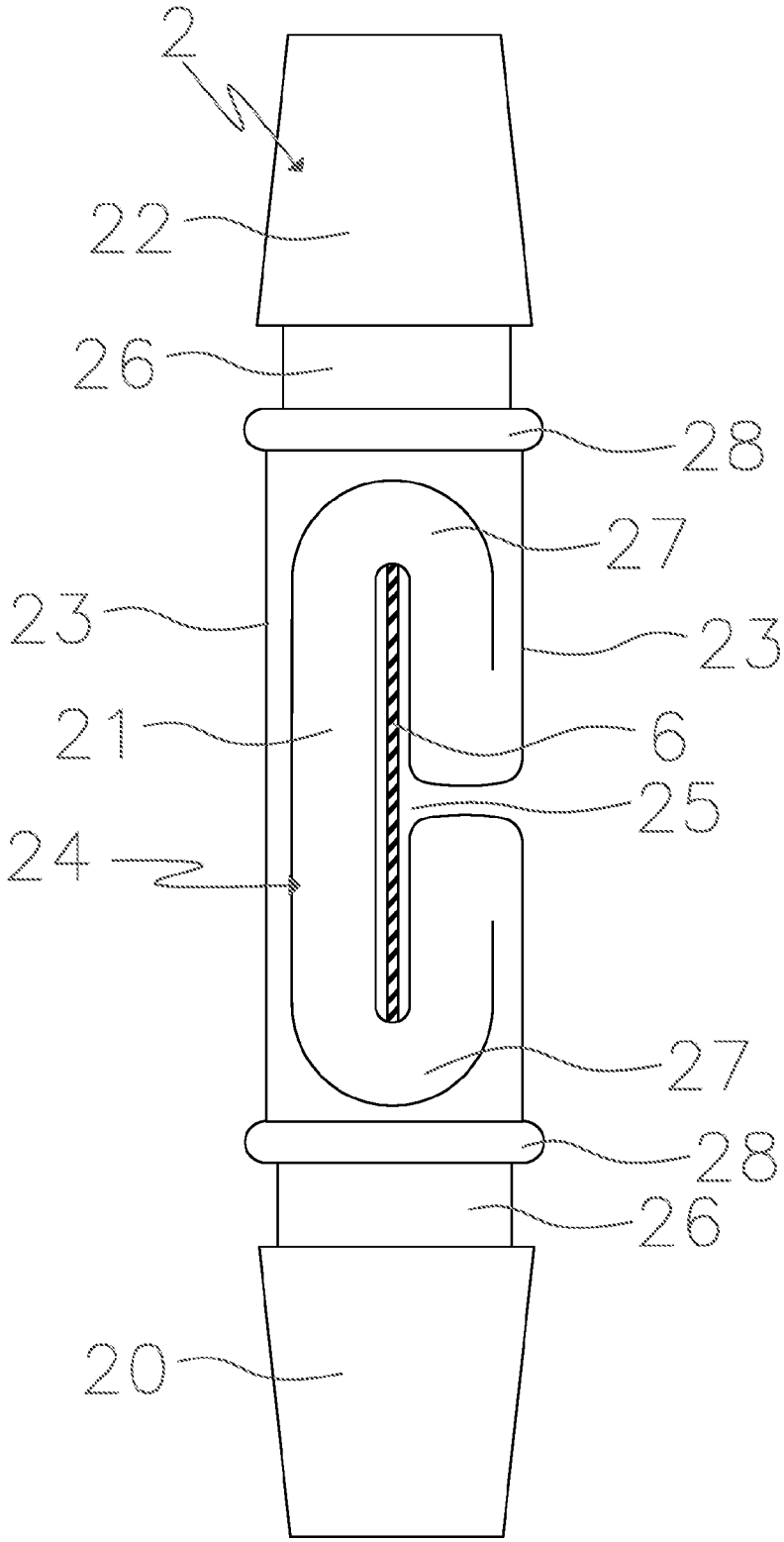
FIG. 6 is a side view of the second configuration showing a section of caution tape disposed in the slot.
Figure 7:
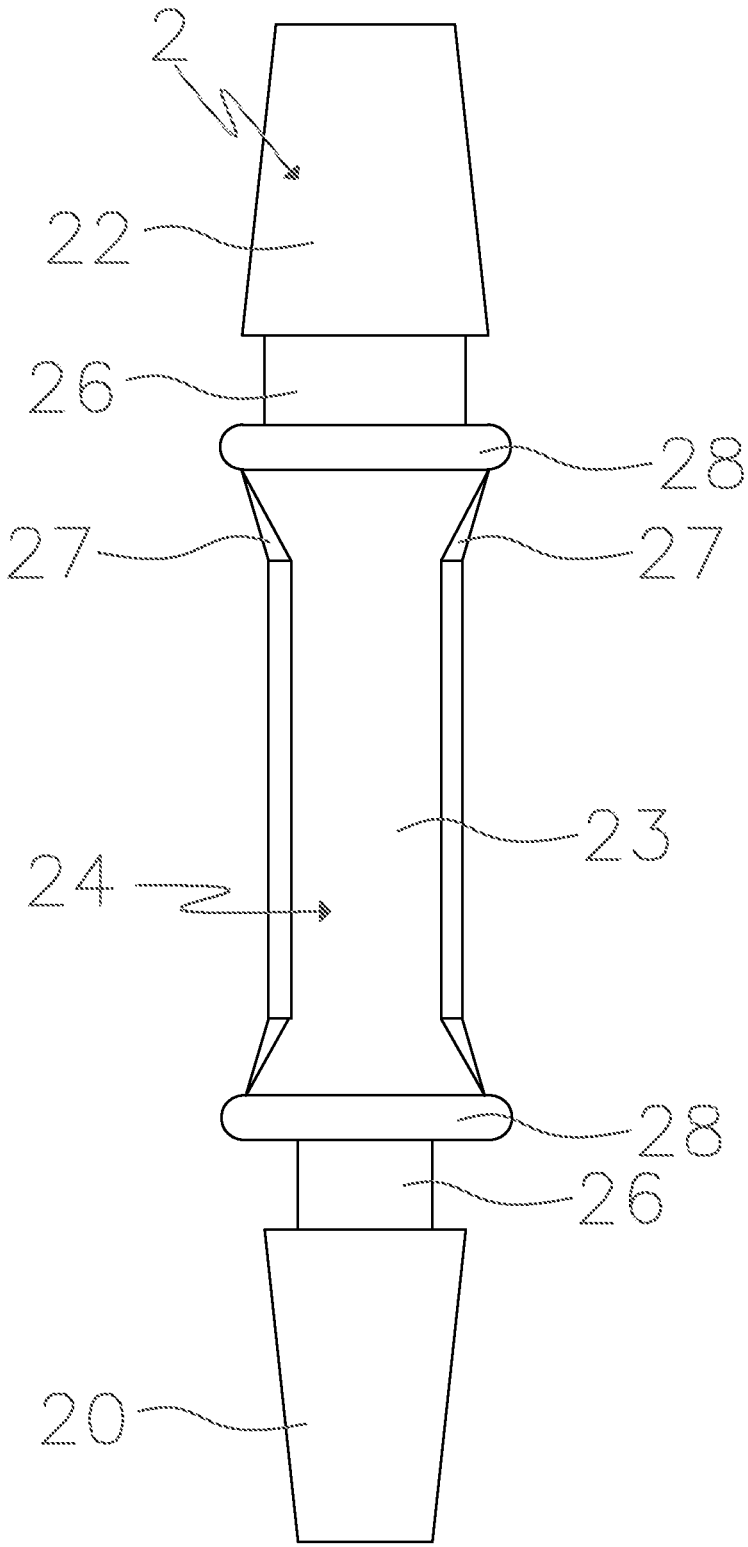
FIG. 7 is a rear view of the insert of FIG. 5.
Figure 8:
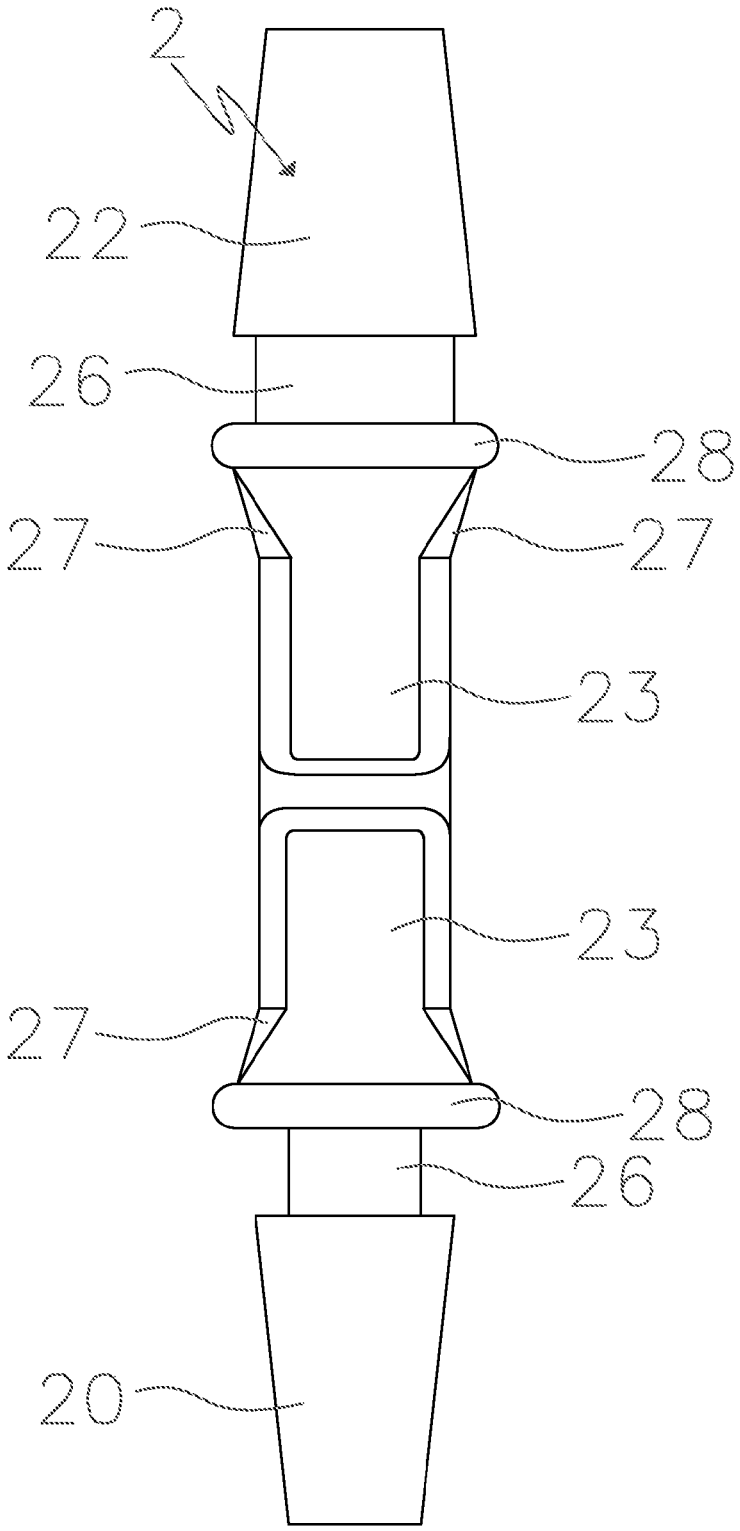
FIG. 8 is a front view of the insert of FIG. 5.
Figure 10:
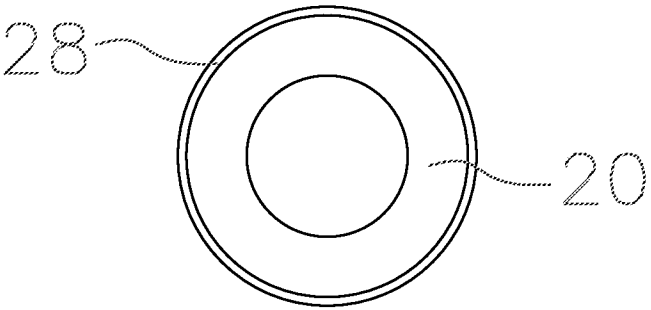
FIG. 10 is a bottom plan view of the insert of FIG. 5.
Figure 9:
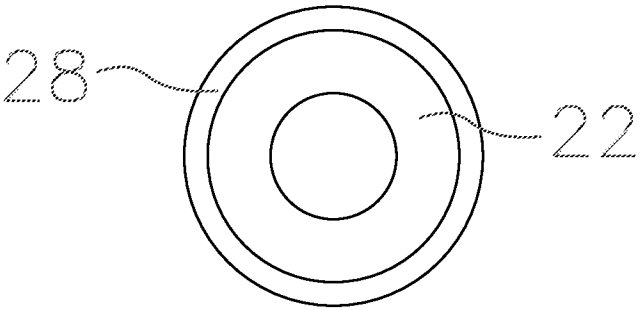
FIG. 9 is a top plan view of the insert of FIG. 5.
Figure 11:
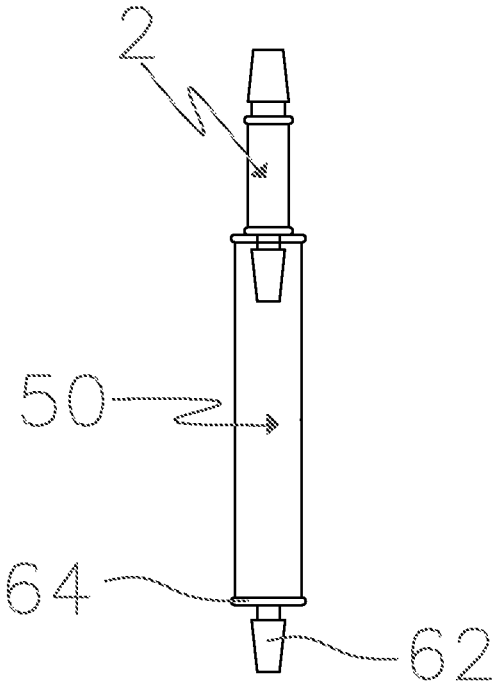
FIG. 11 is a side view of the second configuration of the device used with a fixed-length lift tube.
Figure 12:
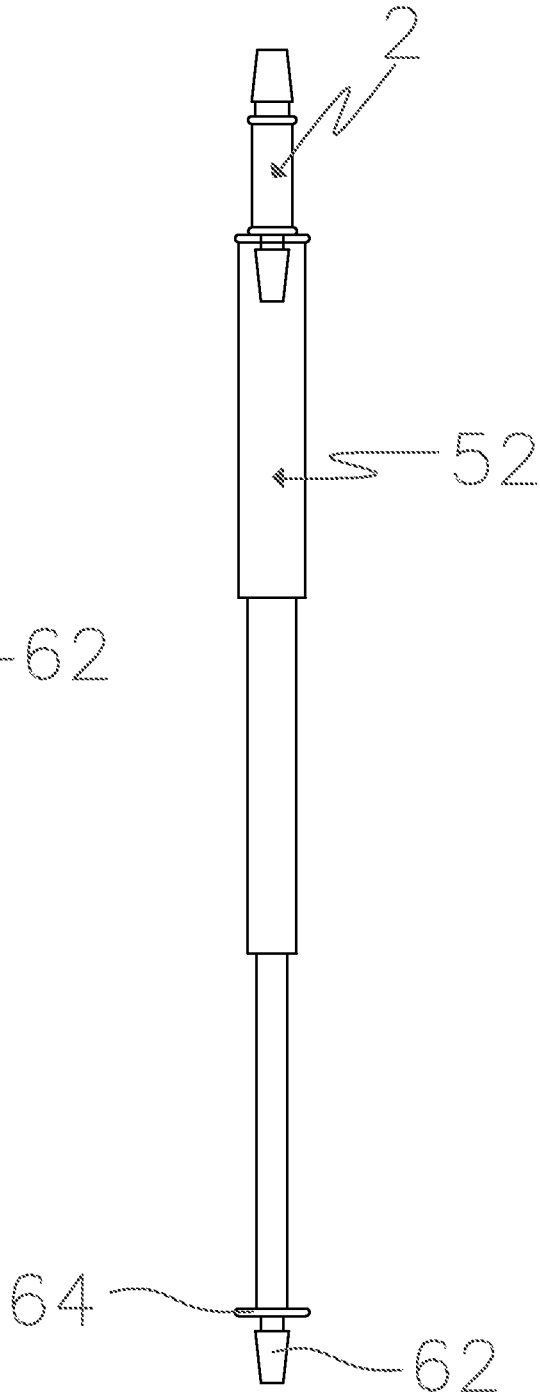
FIG. 12 is a side view of the second configuration of the device used with an adjustable-length lift tube.

The different configurations of the inserts of the invention are generally indicated by the numeral 2 in the accompanying drawings. Insert 2 allows a common traffic control device 4 (such as an open-top traffic safety cone) to be utilized for additional tasks. Insert 2 is simple to use and allows the user to barricade a job site with caution tape to control traffic situations. Insert 2 is used with a traffic cone 4 as shown in FIG. 4 to allow cone 4 to be used with safety or caution tape 6 as shown in FIG. 3. Optionally, a sign 8 as shown in FIGS. 2 and 3 may be used with insert 2. Insert 2 may be used in construction applications, public service applications, property management applications, and other such venues. Inserts 2 may be packaged for sale in groups in stackable containers similar to egg cartons. The groups may include four or eight inserts. Heavy users of inserts may purchase boxes or bags of inserts 2. A sign holder 10 may be packaged with inserts 2 or sold separately. Sign holder 10 may include a blank sign or a pre-printed sign. The egg carton-style container may include a compartment for sign holder 10 and sign 8.

A first configuration of insert 2 has a pair of heads 20 and 22 that are each connected to a body 24 with a neck 26. Flanges 28 are disposed between necks 26 and body 24. The necks have different thicknesses so that insert 2 may be inserted into cones 4 having different upper openings. Insert 2 may be configured to function with 18 and 24 inch cones 4 by providing the small neck with a diameter of 0.75 inches and the large neck with a diameter of 1.125 inches. The bottom surfaces (flat ring-shaped surfaces disposed opposite flanges) of heads 20 and 22 overhang or project outwardly from necks 26 so that each head 20 and 22 will snap fit into the top of cone 4. Heads 20 and 22 are tapered so that they may be forced through the opening in the top of cone 4. In this configuration, each head is frusto-conical in shape. Body 24 may have an outwardly curved configuration to define an upper portion and a lower portion. Flanges 28 extend beyond the upper and lower portions to define ledges that may be used to stop tape 6 from slipping off body 24. The upper and lower portions of body 24 may be used to hold two pieces of tape at different levels without the two pieces overlapping. The shape of body 24 also allows the hand is easily grasp insert 2 in a comfortable and secure manner.

Each head 20 and 22 defines an elongated opening 30 configured to receive the mount 32 of sign holder 10. Openings 30 may be round or non-round in cross section. The non-round cross section functions with a complementary mount 32 so that sign holder 10 does not rotate. Sign holder 10 includes a cradle 40 having spaced portions that frictionally receive sign 8. Sign 8 may be slid in between the spaced portions of cradle 40.

A second configuration of insert 2 is depicted in FIGS. 5-10. Second configuration of insert 2 has a pair of heads 20 and 22 that are each connected to a body 24 with a neck 26. The longitudinal direction of insert 2 extends between the centers of heads 20 and 22. In the exemplary configuration, body 24 includes first and second ends that are in the shape of flanges 28 that project outwardly from body 24 and necks 26. Necks 26 have different widths so that insert 2 may be inserted into different cones 4. Each neck 26 has a smaller width than the end of body 24 to define a shelf such that the end of body 24, the shelf, rests on the top of cone 4 when insert 2 is in use. In this configuration, flanges 28 cooperate with necks 26 to define the shelves. The bottom surface (flat ring-shaped surface disposed opposite flange) of each head 20 and 22 overhangs necks 26 so that each head 20 and 22 will snap fit into the top of cone 4. Heads 20 and 22 are tapered so that they may be forced through the opening in the top of cone 4. In addition to allowing insert 2 to be used with different cones 4, two heads 20 and 22 are provided so that one head will be disposed up above body 24 when insert 2 is in use. This head may be used as a handle for cone 4, may be wrapped with a different section of caution tape 6, may support a sign 8, may support a light, or may simply increase the visibility of the assembly.

The following exemplary dimensions have been found to be functional with eighteen and twenty-four inch cones 4. In this configuration, heads 20 and 22 are frusto-conical with necks 26 and flanges 28 being disc-shaped. As such, the term "diameter" is used to describe the following configurations. In other configurations, heads 20 and 22 are provided in non-conical shapes with necks and flanges also being provided in other shapes. When other shapes are used, widths in the ranges of the following diameters may be used. Also, when insert 2 is to be used with a larger cone 4, the dimensions may be enlarged as needed. In this exemplary configuration, the large head 20 has a height of 1.625 to 1.875 inches with a large diameter of 1.375 to 1.625 inches at its inner end and a small diameter of 0.750 to 1.000 inches at its outer end. Small head 22 has a height of 1.625 to 1.875 inches with a large diameter of 1.250 to 1.500 inches at its inner end and a small diameter of 0.625 to 0.875 inches at its outer end. Necks 26 have a diameter of 0.125 to 0.375 inches less than the diameter of the inner ends heads 20 and 22 thus defining about a 0.125 inch bottom surface or shoulder between the inner ends of heads 20 and 22 and neck 26. These shoulders extend entirely about the heads. These shoulders are disposed inside cone 4 when insert 2 is in use to prevent insert 2 from being readily pulled out of the top of cone 4. This shoulder may be sufficient to allow cone 4 to be lifted by insert 2 thus allowing insert 2 to act as a handle for cone 4. Flanges 28 are about 0.188 inches thick and have a diameter of 1.250 to 1.750 inches. These flanges 28 sit on top of cone 4 to prevent insert 2 from falling down inside cone 4 during use.

Body 24 may have an outwardly curved configuration to define an upper portion and a lower portion as described above or may have a constant-area cross sectional shape such as a square, circle, or polygon. In the exemplary configuration depicted in the drawings, body 24 has a generally rectangular central portion 21 with rounded thin sides 23 that extend between flanges 28. The sides of end portions 27 of body 24 are tapered from the round shape of flanges 28 to the generally rectangular shape of the central portion 21. Decreasing the cross section of the central portion 21 strengthens body 24 and allows the tapered end portions 27 of body 24 to overhang the slot 25 that receives caution tape 6. These overhangs help to retain tape 6 that is wrapped at least partially around the exterior of central portion 21. In addition, flanges 28 overhang end portions 27 to function as backup tape retention devices that stop tape 6 from completely slipping off body 24 when tape 6 is wrapped around the exterior of central portion 21. Central portion 21 of body 24 defines a T-shaped slot 25 that enters body 24 at a slot inlet defined through one of the thin rounded sides 23 of the generally rectangular central body portion 21. Slot 25 is used to receive one or more (multiple tapes will fit in slot 25) sections of tape 6 and has an elongated main portion that has a height (disposed in the longitudinal direction of insert 2) that is just slightly taller than tape 6 such that tape 6 may remain at its full visible width when supported by insert 2 (See FIG. 6). When the size of insert 2 is matched with tape 6, then tape 6 does not have to be folded over or pinched or crumbled when disposed in slot 25 thus allowing the full width of tape 6 to be viewed while insert 2 is in use. In other configurations, slot 25 is at least L-shaped wherein one slot arm extends up from an entrance slot that extends out of body 24. Slot 25 also may be T-shaped with a pair of oppositely-extending slot arms extend from the inner end of an entrance slot. A pair of small tapes 6 may be used at the upper and lower ends of slot 25. Slot 25 extends through body 24 and may have a width of one-eighth of an inch. When configured for use with a three inch tape 6, then slot 25 is about three inches tall with the overall height of insert being about 8.500 inches.

Each head 20 and 22 may define an elongated opening configured to receive the mount 32 of sign holder 10. Such openings may be round or non-round in cross section. The non-round cross section functions with a complementary mount 32 so that sign holder 10 does not rotate. Sign holder 10 includes a cradle 40 having spaced portions that frictionally receive sign 8. Sign 8 may be slid in between the spaced portions of cradle 40.

Insert 2 may be made from a material or coated with a material that reflects light, glows in the dark, or is brightly-colored. Powered lights may be carried by insert 2 in a manner similar to the signs described above. Also, lights may be disposed inside insert 2 so that inserts 2 glow or flash for increased visibility at night.

Figure 13:
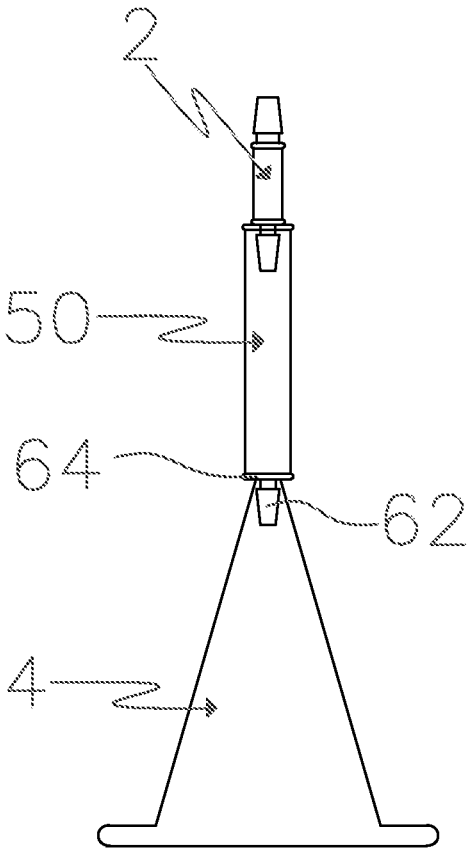
FIG. 13 is a side view of the combination of FIG. 11 used with a traffic cone.
Figure 14:
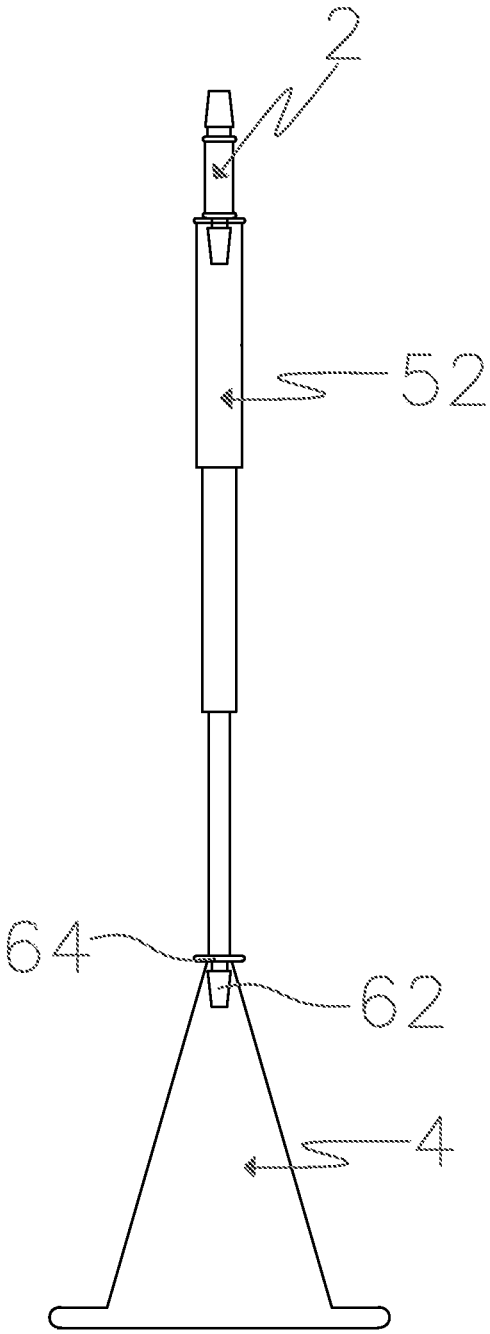
FIG. 14 is a side view of the combination of FIG. 12 used with a traffic cone.

FIGS. 11-14 depict inserts 2 used with lift tubes 50 and 52. Lift tube 50 is a fixed-length tube have an opening defined at one end and a head 62 disposed on its other end. The opening is configured to receive either of heads 20 or 22 of insert 2 while head 62 may match the configuration of head 20 or 22. Head 62 is snapped into the top of traffic cone 4 as depicted in FIG. 13 to raise insert 2 higher from the ground and thus raise the level of tape 6 carried by insert 2. Tubes 50 and 52 may be fabricated from a rigid material or a softer material similar to cone 4. Lift tube 52 is an adjustable-length tube have an opening 60 defined at one end and a head 62 disposed on its other end. Lift tube 52 includes a plurality of body tube sections that telescope with respect each other to allow the overall length of tube 52 to be adjusted. Head 62 of each tube 50 and 52 includes a flange 64 similar to flanges 28 described above. Flange 64 engages the top of cone 4 when insert 2 is in use.

Figure 15:
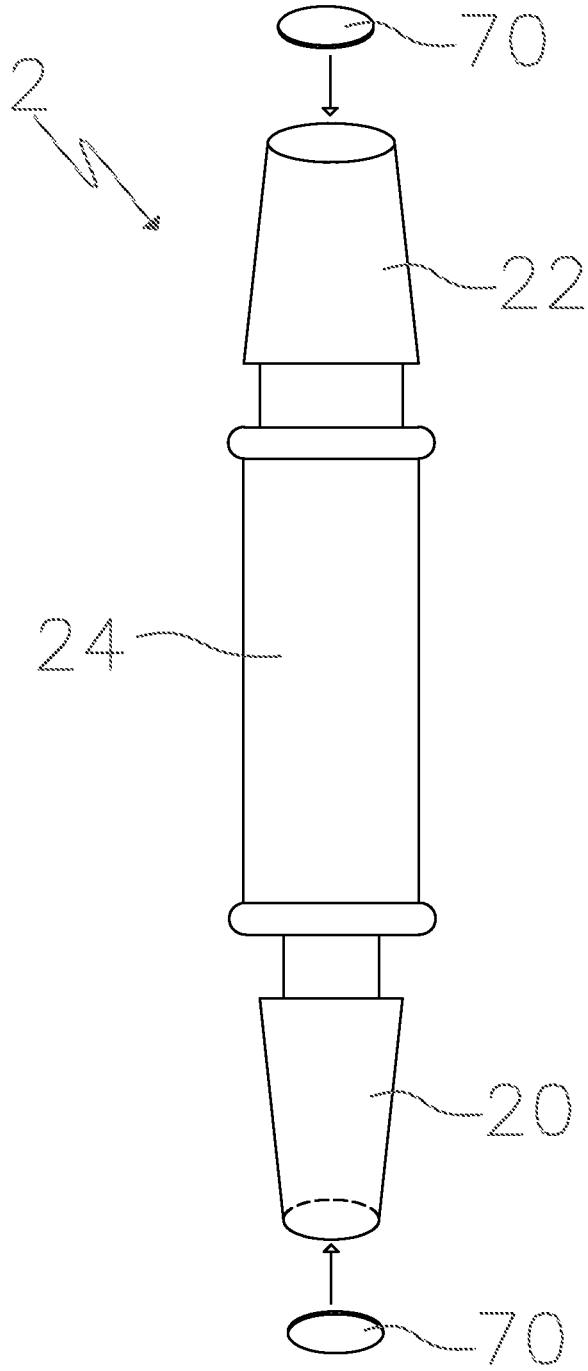
FIG. 15 is a schematic view of a third configuration for the insert with the ends of the heads shown in perspective views wherein one or two magnetic mounts are provided on the end surfaces of the heads.

FIG. 15 depicts a configuration wherein insert 2 includes magnets 70 disposed on the ends of heads 20 and 22. Magnets 70 allow insert 2 to be readily mounted to a metal surface. Magnets 70 also allow a sign or a light to be removably mounted to insert 2. Such a sign or light includes a metal stand that is secured to insert 2 by the magnetic force provided by magnet 70. Magnets 70 may be secured to heads 20 and 22 with adhesive, may be snap fit in place, may be overmolded, or secured with fasteners. Magnets 70 also may be mounted to the side of body of insert 2.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. The dimensional ranges are provided as best embodiments of the insert known at this time. The inventors recognize that other dimensions and shapes may be used that fall with the scope of the claims. Throughout the description and claims of this specification the words "comprise" and "include" as well as variations of those words, such as "comprises," "includes," "comprising," and "including" are not intended to exclude additives, components, integers, or steps.

The invention claimed is:

1. An insert device for supporting caution tape above a traffic cone; the traffic cone having a large lower end and a small upper end with an opening defined at its upper end; the insert device comprising:

a body having a first end and a second end; the body defining a slot adapted to receive a section of caution tape;

a first head connected to the first end of the body with a first neck; the first neck and first end of the body cooperating to define a first shelf adapted to rest against the upper end of the traffic cone when the first head is disposed within the traffic cone and the neck is disposed in the opening defined by the upper end of the traffic cone; the first neck and first head cooperating to define a shoulder; and wherein the body includes flanges disposed at the first and second ends of the body; each flange having a width greater than the opening defined by the upper end of the traffic cone such that one of the flanges will prevent the body of the insert from falling into the traffic cone; each of the flanges projecting outwardly from the body to define stops at the first and second ends of the body.

2. An insert device for supporting caution tape above a traffic cone; the traffic cone having a large lower end and a small upper end with an opening defined at its upper end; the insert device comprising:

a body having a first end and a second end; the body defining a slot adapted to receive a section of caution tape;

a first head connected to the first end of the body with a first neck; the first neck and first end of the body cooperating to define a first shelf adapted to rest against the upper end of the traffic cone when the first head is disposed within the traffic cone and the neck is disposed in the opening defined by the upper end of the traffic cone; and wherein the first head is frusto-conical with a large end and a small end; the large end connected to the first neck.

3. The device of claim 2, wherein the body has a central portion and a pair of tapered end portions; the central portion defining the slot.

4. The device of claim 3, wherein the central portion is rectangular in shape with a pair of rounded thin sides; the slot extending through one of the rounded thin sides of the central portion.

5. The device of claim 2, wherein the slot is T-shaped.

6. The device of claim 2, wherein the first head has an end; a magnet disposed on the end of the first head.

7. The device of claim 2, further comprising a lift tube having a first end and a second end; the first end of the lift tube defining an opening; the first head of the insert being disposed in the opening.

8. An insert device for supporting caution tape above a traffic cone; the traffic cone having a large lower end and a small upper end with an opening defined at its upper end; the insert device comprising:

a body having a first end and a second end; the body defining a slot adapted to receive a section of caution tape; and a first head connected to the first end of the body with a first neck; the first neck and first end of the body cooperating to define a first shelf adapted to rest against the upper end of the traffic cone when the first head is disposed within the traffic cone and the neck is disposed in the opening defined by the upper end of the traffic cone;

a lift tube having a first end and a second end; the first end of the lift tube defining an opening; the first head of the insert being disposed in the opening; and wherein the lift tube has an adjustable length.

9. The device of claim 8, further comprising a head disposed at the second end of the lift tube.

10. An insert device for supporting caution tape above a traffic cone; the traffic cone having a large lower end and a small upper end with an opening defined at its upper end; the insert device comprising:

a body having a first end and a second end; the body defining a slot adapted to receive a section of caution tape; flanges disposed at the first and second ends of the body; each flange having a width greater than the opening defined by the upper end of the traffic cone such that one of the flanges will prevent the body of the insert from falling into the traffic cone;

a first head connected to the first end of the body with a first neck; the first neck and first head cooperating to define a first shoulder; the first neck having a width that is less than the width of the flanges;

the first head having a large end and a small end; the large end of the first head being connected to the first neck;

a second head connected to the second end of the body with a second neck; the second neck and second head cooperating to define a second shoulder; the second neck having a width that is less than the width of the flanges;

the second head having a large end and a small end; the large end of the second head being connected to the second neck; and the large end of the first head being larger than the large end of the second head.

11. The device of claim 10, wherein the slot is T-shaped and has an inlet portion and an elongated main portion.

12. The device of claim 11, wherein the body has a central portion and a pair of tapered end portions; the central portion defining the slot.

13. The device of claim 12, wherein the central portion is rectangular in shape with a pair of rounded thin sides; the slot extending through one of the rounded thin sides of the central portion.

14. The device of claim 10, wherein the flanges extend beyond the body to define retention devices.

15. The device of claim 10, wherein the slot is L-shaped.

16. An insert device for supporting caution tape above a traffic cone; the traffic cone having a large lower end and a small upper end with an opening defined at its upper end; the insert device comprising:

a body having a first end and a second end; the body adapted to receive a section of caution tape;

a first neck connected to the first end of the body; the first neck and first end of the body cooperating to define a shelf adapted to rest against the upper end of the traffic cone when the insert device is supported by the traffic cone;

a first head connected to the first neck; the first neck and first head cooperating to define a first shoulder; and the first head having a large end and a small end; the large end of the first head being connected to the first neck.

17. The device of claim 16, further comprising:

a second head connected to the second end of the body with a second neck; the second neck and second head cooperating to define a second shoulder; and the second head having a large end and a small end; the large end of the second head being connected to the second neck.

18. The device of claim 17, wherein at least one of the first and second heads is frusto-conical.

19. The device of claim 16, wherein the body is tapered at the first and second ends.

20. The device of claim 19, wherein the body defines a slot to receive the section of caution tape.

* * * * *